US011682507B2

(12) United States Patent
Yoshidome et al.

(10) Patent No.: US 11,682,507 B2
(45) Date of Patent: Jun. 20, 2023

(54) COIL COMPONENT

(71) Applicant: TDK CORPORATION, Tokyo (JP)

(72) Inventors: Kazuhiro Yoshidome, Tokyo (JP); Hiroyuki Matsumoto, Tokyo (JP); Hitoshi Ohkubo, Tokyo (JP); Atsuyuki Nakano, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/800,299

(22) Filed: Feb. 25, 2020

(65) Prior Publication Data

US 2020/0279675 A1 Sep. 3, 2020

(30) Foreign Application Priority Data

Feb. 28, 2019 (JP) ..... JP2019-035312

(51) Int. Cl.
*H01F 1/147* (2006.01)
*H01F 27/245* (2006.01)
(Continued)

(52) U.S. Cl.
CPC ..... *H01F 1/147* (2013.01); *C22C 38/002* (2013.01); *C22C 38/02* (2013.01); *C22C 38/12* (2013.01);
(Continued)

(58) Field of Classification Search
CPC .. H01F 1/147; H01F 1/15333; H01F 17/0013; H01F 17/0033; H01F 17/04; H01F 17/043; H01F 27/245; H01F 27/25; H01F 27/2804; H01F 2017/0066; H01F 2017/0073; H01F 2017/048; H01F 2027/2809; H01F 3/04; H01F 27/24; C22C 38/002; C22C 38/02; C22C 38/12; C22C 2202/02
See application file for complete search history.

(56) References Cited

U.S. PATENT DOCUMENTS

2010/0108196 A1* 5/2010 Ohta ..... C22C 38/02 148/121
2015/0123604 A1* 5/2015 Lee ..... H02J 50/12 320/108
(Continued)

FOREIGN PATENT DOCUMENTS

CN 105702434 A 6/2016
CN 105742029 A 7/2016
(Continued)

OTHER PUBLICATIONS

Machine Translation of JP 2008-112830 via EPO (Year: 2008).*
(Continued)

*Primary Examiner* — Laura C Powers
*Assistant Examiner* — Rebecca L Grusby
(74) *Attorney, Agent, or Firm* — Oliff PLC

(57) ABSTRACT

A coil component having high inductance while suppressing core loss is obtained. The coil component includes a coil and a magnetic core. The magnetic core has a laminated body in which soft magnetic layers are laminated. Micro gaps are formed in the soft magnetic layers. The soft magnetic layers are divided into at least two or more small pieces by the micro gaps. A structure made of Fe-based nano-crystals is observed in the soft magnetic layers.

11 Claims, 2 Drawing Sheets

(51) Int. Cl.

| | |
|---|---|
| ***C22C 38/02*** | (2006.01) |
| ***C22C 38/00*** | (2006.01) |
| ***C22C 38/12*** | (2006.01) |
| ***H01F 1/153*** | (2006.01) |
| ***H01F 27/25*** | (2006.01) |

(52) U.S. Cl.
CPC ..... *H01F 1/15333* (2013.01); *H01F 27/245* (2013.01); *H01F 27/25* (2013.01); *C22C 2202/02* (2013.01)

(56) References Cited

U.S. PATENT DOCUMENTS

| | | | | |
|---|---|---|---|---|
| 2016/0172098 | A1 | 6/2016 | Jeong et al. | |
| 2016/0189863 | A1 | 6/2016 | Park et al. | |
| 2016/0293316 | A1 | 10/2016 | Park et al. | |
| 2016/0345474 | A1* | 11/2016 | Oh | H04B 5/0037 |
| 2018/0171444 | A1* | 6/2018 | Kwon | C22C 38/12 |
| 2018/0240582 | A1* | 8/2018 | Cho | H01F 1/15358 |
| 2018/0308612 | A1 | 10/2018 | Park et al. | |
| 2018/0366246 | A1 | 12/2018 | Park et al. | |
| 2020/0279674 | A1 | 9/2020 | Yoshidome et al. | |
| 2020/0279678 | A1 | 9/2020 | Yoshidome et al. | |
| 2021/0005364 | A1* | 1/2021 | Nakahata | H01F 41/0226 |
| 2022/0270792 | A1* | 8/2022 | Yoon | H01F 1/14708 |

FOREIGN PATENT DOCUMENTS

| | | | | |
|---|---|---|---|---|
| CN | 108140468 | A | | 6/2018 |
| CN | 108292555 | A | | 7/2018 |
| JP | 2008112830 | A | * | 5/2008 |
| JP | 2011134959 | A | * | 7/2011 |
| JP | 2013138044 | A | * | 7/2013 |
| JP | 2016-195245 | A | | 11/2016 |
| JP | 2018049921 | A | * | 3/2018 |
| JP | 6451878 | B1 | | 1/2019 |
| JP | 2020-141041 | A | | 9/2020 |
| JP | 2020-141043 | A | | 9/2020 |

OTHER PUBLICATIONS

Machine Translation of JP 2011-134959 via EPO (Year: 2011).*
Machine Translation of JP 2013-138044 via EPO (Year: 2013).*
Machine translation of JP 2018-049921 via EPO (Year: 2018).*

* cited by examiner

COIL COMPONENT

TECHNICAL FIELD

The present invention relates to a coil component.

BACKGROUND

Patent Document 1 discloses an invention of a coil component including a metal magnetic plate is described. The coil component described in Patent Document 1 has improved inductance and the like compared with a coil component that does not include a metal magnetic plate.

[Patent Document 1] JP Patent Application Laid Open. No 2016-195245

However, the coil electronic component described in Patent Document 1 has a disadvantages that core loss increases and temperature rises when used as an inductor.

BRIEF SUMMARY OF THE INVENTION

An object of the present invention is to obtain a coil component having high inductance while suppressing core loss and suppressing temperature rises.

In order to achieve the above object, the coil component of the present invention includes a coil and a magnetic core, wherein the magnetic core has a laminated body in which soft magnetic layers are laminated, micro gaps are formed in the soft magnetic layers, the soft magnetic layers are divided into at least two or more small pieces by the micro gaps, and a structure consisting of Fe-based nano-crystals is observed in the soft magnetic layers.

The coil component of the present invention has high inductance while suppressing core loss by having the above-described characteristics.

The number of the small pieces per unit area is preferably 150 pieces/$cm^2$ or more and 10000 pieces/$cm^2$ or less.

soft magnetic layers and adhesion layers may be alternately laminated in the laminated body.

The soft magnetic layers may be arranged substantially in parallel with the flow direction of magnetic fluxes.

The magnetic core may include a magnetic-substance-containing resin, and the magnetic-substance-containing resin may cover at least a part of the coil and at least a part of the laminated body.

Preferably, the soft magnetic layers have a composition formula $(Fe_{(1-(\alpha+\beta))}X1_{\alpha}X2_{\beta})_{(1-(a+b+c+d+e+f))}M_aB_bP_cSi_dC_eS_f$, X1 is one or more elements selected from a group consisting of Co and Ni, X2 is one or more elements selected from a group consisting of Al, Mn, Ag, Zn, Sn, As, Sb, Cu, Cr, Bi, N, O and rare earth elements, M is one or more elements selected from a group consisting of Nb, Hf, Zr, Ta, Mo, W, Ti and V, $0 \le a \le 0.140$ $0.020 \le b \le 0.200$ $0 \le c \le 0.150$ $0 \le d \le 0.090$ $0 \le e \le 0.030$ $0 \le f \le 0.030$ $\alpha \ge 0$ $\beta \ge 0$ $0 \le \alpha+\beta \le 0.50$, and at least one or more elements of a, c and d is greater than zero.

Preferably, the thickness of each of the soft magnetic layers is 10 μm or more and 30 μm or less.

Preferably, a volume occupation of a magnetic material in the laminated body is 50% or more and 99.5% or less.

Preferably, the average grain size of the Fe-based nano-crystals is 5 nm or more and 30 nm or less.

DETAILED DESCRIPTION OF INVENTION

Preferred embodiments of the present invention are described below with reference to the drawings, but the embodiments of the present invention are not limited to the following embodiments.

Figure 1:
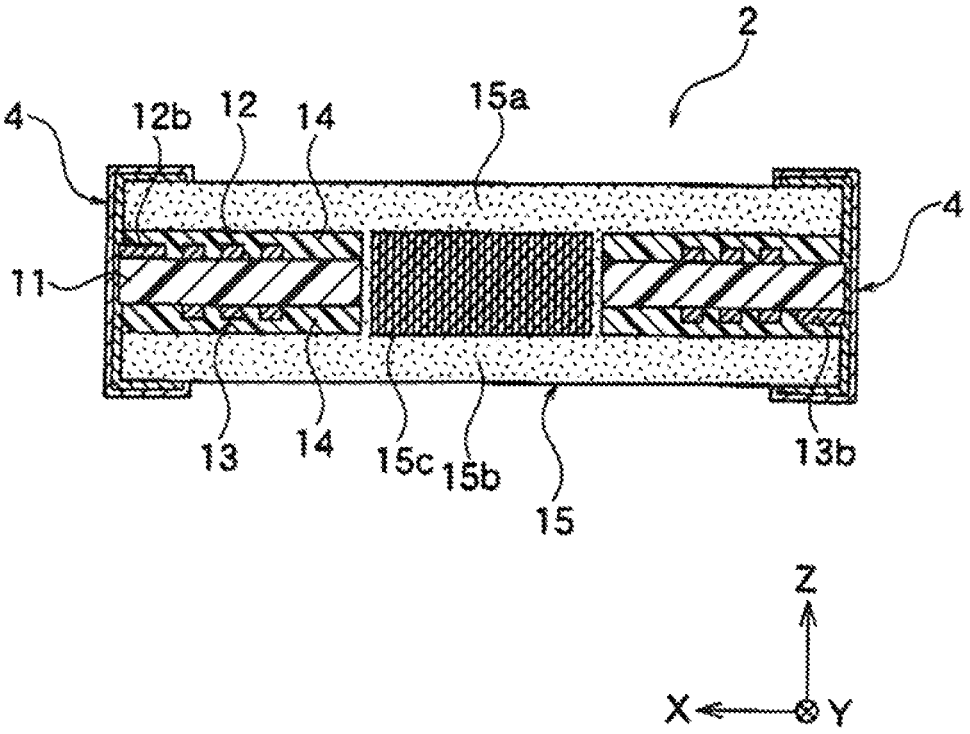
FIG. 1 is a schematic cross-sectional view of a coil component according to the embodiment.

One embodiment of the coil component according to the present invention may be a coil component 2 shown in FIG. 1. As shown in FIG. 1, the coil component 2 includes a magnetic core 15 having a rectangular flat-plate shape and a pair of terminal electrodes 4, 4 respectively attached to both ends of the magnetic core 15 in the X-axis direction. The terminal electrodes 4, 4 cover end surfaces of the magnetic core 15 in the X-axis direction and partially cover upper and lower surfaces of the magnetic core 15 in the Z-axis direction near the end surfaces in the X-axis direction. Furthermore, the terminal electrodes 4, 4 also partially cover a pair of side surfaces of the magnetic core 15 in the Y-axis direction.

The magnetic core 15 consists of an upper core 15*a*, a lower core 15*b*, and a laminated body 15*c*. The coil component 2 according to the embodiment can improve inductance in a manner that the magnetic core 15 has the multi-layer body 15*c*.

The dimension of the laminated body 15*c* is not particularly limited. For example, a length of one side may be 200 μm or more and 1600 μm or less.

The laminated body 15*c* is formed by laminating soft magnetic layers. In the laminated body 15*c*, the soft magnetic layers are preferably arranged substantially in parallel with the flow direction of magnetic fluxes. By arranging the direction of the soft magnetic layers substantially in parallel with the flow direction of the magnetic fluxes, the effect of improving an inductance is increased. In addition, the magnetic fluxes tend to be difficult to concentrate on the soft magnetic layers, and an increase in core loss can be suppressed.

In FIG. 1, the flow direction of the magnetic fluxes passing through the laminated body 15*c* is the Z-axis direction. The lamination direction of the soft magnetic layers in the laminated body 15*c* is the X-axis direction. Since the soft magnetic layers are arranged substantially in parallel with a Y-Z plane, the soft magnetic layers are arranged substantially in parallel with the flow direction of the magnetic fluxes. That is, in the case of FIG. 1, in order for the soft magnetic layers to be arranged substantially in parallel with the flow direction of the magnetic fluxes, the lamination direction of the soft magnetic layers in the laminated body 15*c* may be a direction perpendicular to the Z-axis direction.

In addition, micro gaps are formed in the soft magnetic layers of the embodiment. At least a part of the micro gaps is preferably formed substantially in parallel with the flow direction of the magnetic fluxes.

Besides, the soft magnetic layers are divided into at least two or more small pieces by the micro gaps. By dividing the soft magnetic layers into at least two or more small pieces, changes in soft magnetic characteristics due to stress during manufacture of the laminated body 15*c* are suppressed, and particularly, an increase in coercive force is suppressed. Then, the inductance of the coil component 2 is further easily increased, and the increase in the core loss is further easily suppressed.

The width of the micro gaps is not particularly limited and may be, for example, 10 nm or more and 1000 nm or less. In addition, the number of the small pieces is not particularly limited either. The number of the small pieces per unit area in an arbitrary cross section is preferably 150 pieces/$cm^2$ or more and 10000 pieces/$cm^2$ or less.

The thickness of each of the soft magnetic layers (the average thickness of each of the soft magnetic layers) is preferably 10 μm or more and 30 μm or less. By controlling the thickness of each of the soft magnetic layers to 10 μm or more and 30 μm or less, an increase in the core loss can be suppressed. In addition, the area of each of the soft magnetic layers is preferably 0.04 $mm^2$ or more and 1.5 $mm^2$ or less. When S1 is 0.04 $mm^2$ or more, there is a tendency to obtain high inductance in the laminated body. When S1 is 1.5 $mm^2$ or less, there is a tendency to obtain an effect of further suppressing an increase in core loss.

In addition, the laminated body 15*c* may be formed by alternately laminating soft magnetic layers and adhesion layers. The type of the adhesion layers is not particularly limited. For example, an adhesion layer in which an acrylic adhesive, an adhesive made of silicone resin, butadiene resin or the like, hot melt, or the like is applied on a surface of a base material may be employed. In addition, the material of the base material may be a resin film. A PET film is typical as the material of the base material. In addition to the PET film, for example, a polyimide film, a polyester film, a polyphenylene sulfide (PPS) film, a polypropylene (PP) film, a polytetrafluoroethylene (PTFE) film, and other fluorine resin films may be listed. In addition, the acrylic resin or the like can be directly applied on a main surface of a soft magnetic ribbon after a heat treatment described later (which eventually becomes a soft magnetic layer), then the acrylic resin or the like can become the adhesion layer.

In addition, one soft magnetic layer or soft magnetic layers may be laminated in the laminated body 15*c*. Preferably, there are soft magnetic layers included in the laminated body of the embodiment, for example, two layers or more and 10000 layers or less.

In addition, the volume occupation of the magnetic material in the laminated body 15*c* is not particularly limited. The volume occupation of the magnetic material is preferably 50% or more and 99.5% or less. If the volume occupation of the magnetic material is 50% or more, the saturation magnetic flux density of the coil can be sufficiently increased. In addition, if the volume occupation of the magnetic material is 99.5% or less, the laminated body 15*c* is not easily damaged, and the coil component 2 can be easily handled. Moreover, in the embodiment, the volume of the magnetic material is substantially coincident with the volume of the soft magnetic layers.

The magnetic core 15 has an insulation substrate 11 at the center in the Z-axis direction.

The insulation substrate 11 is preferably made of a general printed substrate material in which a glass cloth is impregnated with an epoxy resin. However, the material of the insulation substrate 11 is not particularly limited.

In addition, in the embodiment, the resin substrate 11 has a rectangular shape, but other shapes may also be employed. A method for forming the resin substrate 11 is not particularly limited, and the resin substrate 11 is formed by, for example, injection molding, a doctor blade method, screen printing, or the like.

In addition, an internal electrode pattern including a circular spiral internal conductor passage 12 is formed on an upper surface (one main surface) in the Z-axis direction of the insulation substrate 11. The internal conductor passage 12 finally becomes a coil. In addition, the material of the internal conductor passage 12 is not particularly limited.

A connection end is formed at an inner peripheral end of the spiral internal conductor passage 12. In addition, a lead contact 12*b* is formed at an outer peripheral end of the spiral internal conductor passage 12 in a manner of being exposed along one end of the magnetic core 15 in the X-axis direction.

On a lower surface (the other main surface) in the Z-axis direction of the insulation substrate 11, an internal electrode pattern including a spiral internal conductor passage 13 is formed. The inner conductor passage 13 finally becomes a coil. In addition, the material of the inner conductor passage 13 is not particularly limited.

A connection end is formed at an inner peripheral end of the spiral inner conductor passage 13. In addition, a lead contact 13*b* is formed at an outer peripheral end of the spiral inner conductor passage 13 in a manner of being exposed along one end of the magnetic core 15 in the X-axis direction.

Positions and the connection method of the connection ends respectively formed in the internal conductor passages 12, 13 are not particularly limited. For example, the connection ends may be formed on opposite sides with the insulation substrate 11 located therebetween in the Z-axis direction, and may be formed at the same position in the X-axis direction and the Y-axis direction. Besides, the connection ends may be electrically connected through a through-hole electrode embedded in a through-hole formed in the insulation substrate 11. That is, the spiral internal conductor passage 12 and the spiral inner conductor passage 13 may be electrically connected in series through the through-hole electrode.

The spiral internal conductor passage 12 as viewed from the upper surface side of the insulation substrate 11 configures a spiral from the lead contact 12*b* at the outer peripheral end toward the connection end at the inner peripheral end.

On the other hand, the spiral inner conductor passage 13 as viewed from the upper surface side of the insulation substrate 11 configures a spiral from the connection end that is the inner peripheral end toward the lead contact 13*b* that is the outer peripheral end.

The internal conductor passage 12 and the inner conductor passage 13 form a spiral in the same direction. Thereby, directions of the magnetic fluxes generated by the currents flowing through the spiral inner conductor passages 12, 13 coincide with each other, and the magnetic fluxes generated in the spiral inner conductor passages 12, 13 are superimposed and strengthened, and great inductance can be obtained.

A method for forming the upper core 15*a* and the lower core 15*b* is not particularly limited. The upper core 15*a* and the lower core 15*b* may be formed integrally with a magnetic-substance-containing resin together with the laminated body 15*c* described later. Besides, the magnetic-substance-containing resin may cover at least a part of the internal conductor passages 12, 13 and at least a part of the laminated body 15*c*.

Protective insulation layers 14 may be interposed between the upper core 15*a* and the internal conductor passage 12. In addition, the protective insulation layers 14 may be interposed between the lower core 15*b* and the internal conductor passage 13. A circular through hole is formed in the center of the protective insulation layer 14. In addition, a circular through hole is also formed in the center of the insulation substrate 11. In the embodiment, the laminated body 15*c* is positioned in these through holes.

Moreover, the protective insulation layer 14 is not essential. In the embodiment, the portion that is the protective insulation layer 14 may be the upper core 15*a* or the lower core 15*b*.

The terminal electrode 4 may have a single-layer structure, a two-layer structure as shown in FIG. 1, or a multilayer structure of three or more layers.

The material of the upper core 15*a* and the lower core 15*b* is not particularly limited. The upper core 15*a* and the lower core 15*b* preferably include a magnetic-substance-containing resin. The magnetic-substance-containing resin is, for example, a magnetic material in which metal magnetic powder is mixed into the resin.

The material of the metal magnetic powder is not particularly limited. For example, the metal magnetic powder may be Fe-based crystal powder, Fe-based amorphous powder, Fe-based nano-crystal powder or the like. In addition, the shape of the metal magnetic powder is not particularly limited either. For example, the metal magnetic powder may be a sphere or an ellipsoid.

The particle diameter of the metal magnetic powder is not particularly limited either. For example, metal magnetic powder having a circle equivalent diameter D50 of 0.1-200 μm may be used.

In addition, the metal magnetic powder may be subjected to insulation coating.

The soft magnetic layers of the laminated body 15*c* is described below.

The soft magnetic layers include Fe-based nano-crystals. The Fe-based nano-crystal is a crystal having a grain size of nano-order and a Fe crystal structure of bcc (body-centered cubic lattice structure). In the embodiment, it is preferable to deposit the Fe-based nano-crystals having an average grain size of 5-30 nm.

The composition of the soft magnetic layers is not particularly limited. Specifically, the soft magnetic layers preferably have a composition formula $(Fe_{(1-(\alpha+\beta))}X1_{\alpha}X2_{\beta})_{(1-(a+b+c+d+e+f))}M_aB_bP_cSi_dC_eS_f$.

X1 is preferably one or more elements selected from a group consisting of Co and Ni, X2 is preferably one or more elements selected from a group consisting of Al, Mn, Ag, Zn, Sn, As, Sb, Cu, Cr, Bi, N, O and rare earth elements, M is preferably one or more elements selected from a group consisting of Nb, Hf, Zr, Ta, Mo, W, Ti and V, $0 \le a \le 0.140$ $0.020 \le b \le 0.200$ $0 \le c \le 0.150$ $0 \le d \le 0.175$ $0 \le e \le 0.030$ $0 \le f \le 0.030$ $\alpha \ge 0$ $\beta \ge 0$ $0 \le \alpha+\beta \le 0.50$, and at least one or more elements of a, c and d is preferably greater than zero.

The M content (a) preferably satisfies $0 \le a \le 0.140$. That is, the soft magnetic layers may not contain M. However, when the soft magnetic layers don't contain M, the magnetostriction constant tends to increase easily and the coercive force tends to increase easily. When a is large, the saturation magnetic flux density of the magnetic core 15 decreases easily, and the direct current superimposition characteristic deteriorates easily. In addition, preferably, $0.020 \le a \le 0.100$ is satisfied, and more preferably, $0.050 \le a \le 0.080$ is satisfied.

The B content (b) preferably satisfies $0.020 \le b \le 0.200$. When b is small, a crystal phase consisting of crystals having a grain size larger than 30 nm is generated easily during manufacture of the soft magnetic ribbon described later, and it is difficult to make the soft magnetic layers into a structure consisting of Fe-based nano-crystals. When b is large, the saturation magnetic flux density of the magnetic core 15 decreases easily. In addition, more preferably, $0.080 \le b \le 0.120$ is satisfied.

The P content (c) preferably satisfies $0 \le c \le 0.150$. That is, the soft magnetic layers may not contain P. The coercive force decreases easily by containing P. When c is large, the saturation magnetic flux density of the magnetic core 15 decreases easily.

The Si content (d) preferably satisfies $0 \le d \le 0.175$. That is, the soft magnetic layers may not contain Si. The Si content (d) may be $0 \le d \le 0.090$.

The C content (e) preferably satisfies $0 \le e \le 0.030$. That is, the soft magnetic layers may not contain C. When e is large, the saturation magnetic flux density of the magnetic core 15 decreases easily.

The S content (f) preferably satisfies $0 \le f \le 0.030$. That is, the soft magnetic layers may not contain S. When f is large, the crystal phase consisting of crystals having a grain size larger than 30 nm is generated easily during manufacture of the soft magnetic ribbon described later, and it is difficult to make the soft magnetic layers into a structure consisting of Fe-based nano-crystals. In addition, the saturation magnetic flux density of the magnetic core 15 decreases easily.

In addition, one or more of a, c, d is preferably greater than zero. For example, when a is great, the soft magnetic layers are Fe-M-B soft magnetic layers; when c is great, the soft magnetic layers are Fe—P—B soft magnetic layers; and when d is great, the soft magnetic layers are Fe—Si—B soft magnetic layers. One or more of a, c, d is preferably 0.001 or more and more preferably 0.010 or more. That is, the soft magnetic layers according to the embodiment preferably include one or more elements of M, P, and Si. The soft magnetic layers are easily formed into the structure consisting of Fe-based nano-crystals by including one or more elements of M, P, and Si.

The Fe content $\{1-(a+b+c+d+e+f\}$ is not particularly limited. The Fe content $\{1-(a+b+c+d+e+f\}$ preferably satisfies $0.730 \le 1-(a+b+c+d+e+f) \le 0.950$. In addition, particularly, when $1-(a+b+c+d+e+f) \le 0.910$, the soft magnetic layers are easily formed into the structure consisting of Fe-based nano-crystals. In addition, the Fe content $\{1-(a+b+c+d+e+f)\}$ may be $1-(a+b+c+d+e+f) \le 0.900$.

In addition, in a soft magnetic alloy according to the embodiment, a part of Fe may be substituted with X1 and/or X2.

X1 is one or more elements selected from the group consisting of Co and Ni. In regard to the X1 content, $\alpha=0$ may be satisfied. That is, the soft magnetic layers may not contain X1. In addition, the number of atoms of X1 is preferably 40 at % or less when the number of atoms of the entire composition is designated as 100 at %. That is, $0 \leq \alpha\{1-(a+b+c+d+e+f)\} \leq 0.40$ is preferably satisfied.

X2 is one or more elements selected from the group consisting of Al, Mn, Ag, Zn, Sn, As, Sb, Cu, Cr, Bi, N, O and rare earth elements. In regard to the X2 content, $\beta=0$ may be satisfied. That is, the soft magnetic layers may not contain X2. In addition, the number of atoms of X2 is preferably 3.0 at % or less when the number of atoms of the entire composition is designated as 100 at %. That is, $0 \leq \beta\{1-(a+b+c+d+e+f)\} \leq 0.030$ is preferably satisfied.

The range of a substitution amount for substituting Fe with X1 and/or X2 is set to be a half or less of the number of atoms. That is, the range of the amount of substitution is set to be such that $0 \leq \alpha+\beta \leq 0.500$. In the case of $\alpha+\beta>0.50$, it is difficult to form the soft magnetic layers into the structure consisting of Fe-based nano-crystals.

Moreover, the soft magnetic layers according to the embodiment may contain elements other than those described above as unavoidable impurities in a range where the characteristics are not greatly affected. For example, the soft magnetic layers may include the unavoidable impurities at a proportion of 1 wt % or less with respect to 100 wt % of the soft magnetic layers.

A manufacturing method of the coil component 2 according to the embodiment is described below.

First, the spiral internal conductor passages 12, 13 are formed on the upper and lower surfaces of the insulation substrate 11 by a plating method. A known plating method can be used for plating, and the internal conductor passages 12, 13 may be formed by a method other than the plating method. In addition, when the internal conductor passages 12, 13 are formed by electrolytic plating, a base layer may be formed in advance by electroless plating.

Next, the protective insulation layers 14 are formed on both surfaces of the insulation substrate 11 in which the internal conductor passages 12, 13 are formed. The method for forming the protective insulation layer 14 is not particularly limited. For example, the protective insulation layer 14 can be formed by immersing the insulation substrate 11 in a resin solution diluted with a high boiling point solvent and drying the insulation substrate 11.

Next, the protective insulation layer 14 in contact with the internal conductor passage 13 is fixed on a UV tape. Moreover, the reason for fixing the protective insulation layer 14 on the UV tape is to suppress the insulation substrate 11 from warping in the process described later.

Next, a magnetic-substance-containing resin paste with the metal magnetic powder dispersed therein is prepared. The magnetic-substance-containing resin paste is manufactured by, for example, mixing the metal magnetic powder with a thermosetting resin, a binder, and a solvent.

Next, a through hole is arranged in the insulation substrate 11 and the protective insulation layer 14. Then, the laminated body 15*c* is inserted into the through hole. The size of the through hole may be sufficient to insert the laminated body 15*c*.

Then, the magnetic-substance-containing resin paste is applied on the protective insulation layer 14 on the internal conductor passage 12 side by screen printing. At this time, a mask and/or a squeegee are used as necessary. By applying the magnetic substance-containing resin paste using screen printing, the internal conductor passage 12 side is integrally covered with the magnetic-substance-containing resin paste, and the through hole is also filled with the magnetic-substance-containing resin paste. Then, the magnetic-substance-containing resin is thermally cured, and the solvent component is volatilized to form the upper core 15*a*.

Subsequently, the insulation substrate 11, the internal conductor passages 12, 13, the protective insulation layers 14, the upper core 15*a*, and the laminated body 15*c* are turned upside down and the UV tape is removed. Then, the magnetic-substance-containing resin paste is applied on the protective insulation layer 14 on the internal conductor passage 13 side by screen printing. Then, the lower core 15*b* is formed in the same manner as the upper core 15*a*.

In addition, the upper and lower surfaces of the magnetic core 15 may be ground to keep the magnetic core 15 at a specified thickness. The grinding method is not particularly limited and may be, for example, a method using a fixed grindstone. In addition, heating may be further performed at this stage to advance thermal curing. That is, thermal curing may be performed with stages.

Then, the magnetic core 15 is cut to have specified dimensions. A method for cutting the magnetic core 15 is not particularly limited, and the magnetic core 15 can be cut by a method such as wire cutting, dicing or the like.

With the above method, the magnetic core 15 before the terminal electrode shown in FIG. 1 is formed is obtained. Moreover, in the state before cutting, magnetic cores 15 are integrally connected in the X-axis direction and the Y-axis direction.

In addition, after the cutting, the individualized magnetic core 15 is subjected to an etching process as necessary. Conditions for the etching process are not particularly limited.

Next, the terminal electrode 4 is formed on the magnetic core 15. A case where the terminal electrode 4 includes an inner layer and an outer layer is described below.

First, an electrode material is applied to both ends of the magnetic core 15 in the X-axis direction to form the inner layer. As the electrode material, for example, a conductive powder containing resin is used in which conductive powder such as Ag powder or the like is contained in a thermosetting resin.

Next, terminal plating is performed to a product applied with the electrode paste as the inner layer by barrel plating to form the outer layer. The method and the material for forming the outer layer is not particularly limited, and the outer layer can be formed by, for example, performing Ni plating on the inner layer and further performing Sn plating on the Ni plating. Evidently, the outer layer may consist of only one type of plating, or the outer layer may be formed by a method other than plating. The coil component 2 can be manufactured by the above method.

A method for manufacturing the laminated body 15*c* is specifically described below.

First, a method for manufacturing the soft magnetic ribbon for forming each of the soft magnetic layers is described. In the following, the soft magnetic ribbon may be simply referred to as a ribbon.

The method for manufacturing the soft magnetic ribbon is not particularly limited. For example, there is a method for manufacturing the soft magnetic ribbon according to the embodiment by a single roll method. In addition, the ribbon may be a continuous ribbon.

In the single roll method, first, pure metal of respective metal elements contained in the finally obtained soft magnetic ribbon is prepared and weighed to have the same composition as the finally obtained soft magnetic ribbon. Then, the pure metal of respective metal elements is melted and mixed to manufacture a mother alloy. Moreover, a method for melting the pure metal is not particularly limited and may be, for example, a method in which the pure metal is melted by high-frequency heating after evacuation in a chamber. Moreover, the mother alloy and the finally obtained soft magnetic ribbon consisting of Fe-based nano-crystals usually have the same composition.

Next, the manufactured mother alloy is heated and melted to obtain a molten metal. The temperature of the molten metal is not particularly limited and can be set to, for example, 1100-1350° C.

In the single roll method, the thickness of the obtained ribbon can be adjusted mainly by adjusting a rotation speed of the roll. However, for example, the thickness of the obtained ribbon can also be adjusted by adjusting a distance between a nozzle and the roll, the temperature of the molten metal, and the like. In the embodiment, since the thickness of each of the finally obtained soft magnetic layers is set to 10-30 μm, the thickness of the ribbon is also set to 10-30 μm. Moreover, the thickness of the ribbon substantially coincides with the thickness of each of the finally obtained soft magnetic layer included in the laminated body 15*c*.

The temperature and the rotation speed of the roll and atmosphere inside the chamber are not particularly limited. The temperature of the roll is about room temperature or higher and 80° C. or lower. The average grain size of microcrystals tends to be smaller as the temperature of the roll is lower. The average grain size of the microcrystals tends to be smaller as the rotation speed of the roll is higher. For example, the rotation speed is set to 10-30 msec. The atmosphere inside the chamber is preferably the air atmosphere with consideration of cost.

At the time before the heat treatment described later, the ribbon has an amorphous structure. Moreover, the amorphous structure here includes a nano-hetero structure in which microcrystals are included in the amorphous. By performing the heat treatment described later on the ribbon, the ribbon having the structure consisting of Fe-based nano-crystals can be obtained. Moreover, similarly to the ribbon, each of the soft magnetic layers manufactured using the ribbon which has the structure consisting of Fe-based nano-crystals also has a structure consisting of Fe-based nano-crystals. In addition, the average grain size of the Fe-based nano-crystals is preferably 5 nm or more and 30 nm or less.

When the heat treatment temperature is low, the average grain size of the Fe-based nano-crystals is less than 5 nm. In this case, it is difficult to form the micro gaps described later, and a processing stress increases during punching. Therefore, the coercive force of the laminated body 15*c* tends to increase as in the case of using the amorphous soft magnetic ribbon. In addition, when the average grain size of the Fe-based nano-crystals exceeds 30 nm, the coercive force of the soft magnetic ribbon tends to increase.

Whether the soft magnetic alloy ribbon has an amorphous structure or a crystal structure can be confirmed by ordinary X-ray diffraction measurement (XRD).

Specifically, an X-ray structural analysis is performed by XRD, an amorphization rate X (%) shown in the following formula (1) is calculated, and it is assumed that when the amorphization rate X is 85% or more, the soft magnetic alloy ribbon has an amorphous structure, and when the amorphization rate X is less than 85%, the soft magnetic alloy ribbon has a crystal structure.

$$X(\%)=100-(Ic/(Ic+Ia)\times 100) \quad (1)$$

Ic: crystalline scattering integrated intensity

Ia: amorphous scattering integrated intensity

Figure 2:
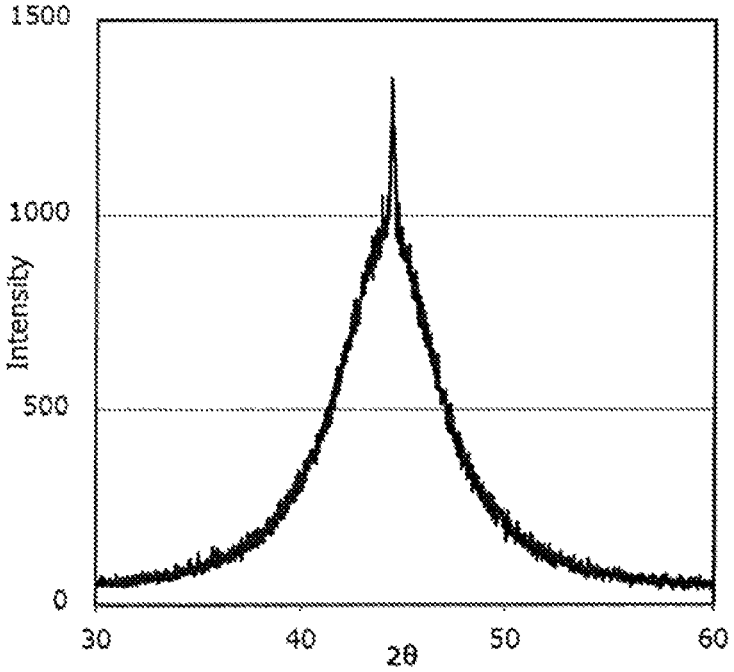
FIG. 2 is a chart obtained by X-ray crystal structure analysis.

In order to calculate the amorphization ratio X, first, the soft magnetic ribbon (one of the soft magnetic layers) according to the embodiment is subjected to the X-ray crystal structure analysis by XRD to obtain a chart shown in FIG. 2. Profile fitting is performed on the chart using the Lorentz function shown in the following formula (2).

[Equation 1]

Equation 1

$$f(x)=\frac{h}{1+\frac{(x-u)^2}{w^2}}+b \quad (2)$$

h: peak height u: peak position w: half width b: background height

Figure 3:
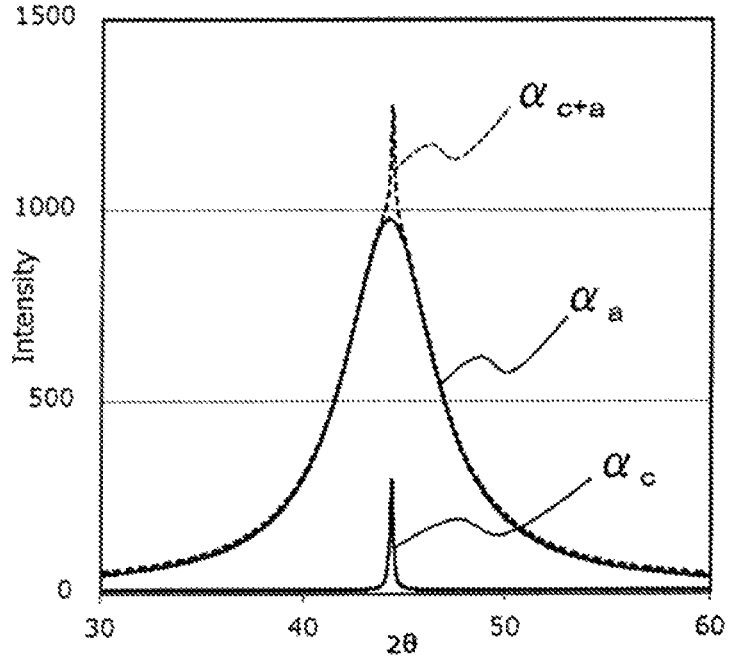
FIG. 3 is a pattern obtained by performing profile fitting on the chart of FIG. 2.

As a result of the profile fitting, a crystal component pattern $\alpha_c$ indicating the crystalline scattering integrated intensity, an amorphous component pattern $\alpha_a$ indicating the amorphous scattering integrated intensity, and a combined pattern $\alpha_{c+a}$ are obtained, all the patterns being shown in FIG. 3. The crystalline scattering integrated intensity Ic and the amorphous scattering integrated intensity Ia are obtained from the obtained respective patterns. From Ic and Ia, the amorphization ratio X is obtained by the above formula (1). Moreover, the measurement range is a range of a diffraction angle 2θ in which an amorphous halo can be confirmed. Specifically, the range is 2θ=30° to 60°. Within this range, an error between the integrated intensity measured by XRD and the integrated intensity calculated using the Lorentz function is within 1%.

In the soft magnetic ribbon of the embodiment, the amorphization ratio ($X_A$) on a surface in contact with the roll surface and the amorphization ratio ($X_B$) on the surface not in contact with the roll surface may be different. In this case, the average of $X_A$ and $X_B$ is set as the amorphization ratio X.

In addition, the average grain size of the nano-crystals can be calculated by, for example, an X-ray diffraction measurement or observation using a transmission electron microscope (TEM). In addition, the crystal structure can be confirmed by, for example, an X-ray diffraction measurement or a limited field diffraction image using a transmission electron microscope (TEM).

Next, the micro gaps are formed in the soft magnetic ribbon to segment the soft magnetic ribbon. A method for segmenting the soft magnetic ribbon is described.

First, each adhesion layer is formed on each soft magnetic ribbon after the heat treatment. The formation of the adhesion layer can be performed using a known method. For example, the adhesion layer may be formed by thinly applying a solution containing a resin to the soft magnetic ribbon and drying the solvent. In addition, a double-sided tape may be attached to the soft magnetic ribbon, and the attached double-sided tape may be used as the adhesion layer. As the double-sided tape in this case, for example, a tape in which both sides of a PET (polyethylene terephthalate) film are applied with an adhesive can be used.

Next, micro gaps are generated in the soft magnetic ribbons on which the adhesion layer is formed. Then, the soft magnetic ribbons are segmented by the micro gaps. A known method can be used as the method for generating the micro gaps. For example, the micro gaps may be generated by applying an external force to the soft magnetic ribbon. As a method for generating the micro gaps by applying an external force, for example, a method of pressing and splitting with a mold, a method of bending through a rolling roll, and the like are known. Furthermore, a predetermined uneven pattern may be arranged in the above mold or the above rolling roll. In addition, in consideration of facilitating formation of the micro gaps substantially in parallel with the flow direction of the magnetic flux, the micro gaps may be generated using a precision processing machine.

Then, micro gaps are formed in each soft magnetic ribbon in a manner that the number of small pieces per unit area is a desired number, and the soft magnetic ribbon is segmented. Moreover, a method for controlling the number of the small pieces per unit area is not limited. In the case of pressing with a mold, for example, the number of the small pieces per unit area can be appropriately changed by changing the pressure at the time of pressing and splitting. In the case of bending through a rolling roll, for example, the number of the small pieces per unit area can be appropriately changed by changing the number of times to pass through the rolling roll.

When the adhesion layer is formed in advance, the small pieces divided by the micro gaps are easily prevented from being scattered. That is, the soft magnetic ribbon after the formation of the micro gaps is divided into small pieces, and the position of any small piece is fixed via the adhesion layer. Regarding the whole soft magnetic ribbon, the shape before the formation of the micro gaps is substantially maintained after the formation of the micro gaps. However, if the micro gaps can be formed while maintaining the shape of the whole soft magnetic ribbon without using the adhesion layer, the adhesion layer is not necessarily formed before the micro gaps are formed.

Next, each soft magnetic ribbon is punched into a specified shape. In the embodiment, punching is performed in a manner that the laminated body 15*c* having a desired shape can be finally manufactured. A known method can be used for the punching process. For example, the soft magnetic ribbon can be clamped between a punching mold having the desired shape and a face plate, and pressure can be applied from the face plate side to the punching mold side or from the punching mold side to the face plate side. Moreover, in the case where the adhesion layer is formed on the soft magnetic ribbon before punching, the soft magnetic ribbon is punched together with the adhesion layer.

The soft magnetic ribbon of the embodiment is hard. Therefore, it is difficult to punch with a weak force. When the soft magnetic ribbon is punched, stress is generated by cutting a punched portion and a remaining portion. The stress increases as the punching force increases. This stress is transmitted to the remaining portion of the soft magnetic ribbon and soft magnetic characteristics are deteriorated. That is, the coercive force tends to increase.

However, in the case of the soft magnetic ribbon consisting of nano-crystals (hereinafter sometimes simply referred to as nano-crystal soft magnetic ribbon), the soft magnetic ribbon can be easily punched as compared with the amorphous soft magnetic ribbon. Furthermore, the micro gaps are also relatively easily formed on the nano-crystal soft magnetic ribbon. When the nano-crystal soft magnetic ribbon has the micro gaps and is segmented, the punching can be performed with a weaker force as compared with a case that the nano-crystal soft magnetic ribbon has no micro gap and is not segmented. Therefore, the above stress is reduced. Furthermore, a portion near a cut surface where stress is generated when the nano-crystal soft magnetic ribbon is punched is physically separated from the other portions. Thus, the above stress is not transmitted to most of the portions other than the vicinity of the cut surface. Then, deterioration of the soft magnetic characteristics due to the stress can be kept to the minimum.

Therefore, when the nano-crystal soft magnetic ribbon has the micro gaps and is segmented, the deterioration of the soft magnetic characteristics (increase of the coercive force) due to the punching is reduced, and the soft magnetic characteristics of the finally obtained laminated body 15*c* are improved. As a result, the soft magnetic characteristics of the magnetic core 15 are improved. Furthermore, when the nano-crystal soft magnetic ribbon has the micro gaps and is segmented, the nano-crystal soft magnetic ribbon can be punched with a relatively weak force, and thus can be easily processed into the desired shape. Therefore, productivity is excellent when the nano-crystal soft magnetic ribbon has the micro gaps and is segmented.

Besides, the laminated body 15*c* of the embodiment can be obtained by laminating the punched nano-crystal soft magnetic ribbons in the thickness direction. In addition, a protective film may be formed on each of one end side and the other end side in the lamination direction (the x-axis direction in FIG. 1). A method for forming the protective film is not limited.

Moreover, the order of each step may be appropriately rearranged.

The laminated body 15*c* according to the embodiment has a structure in which the volume occupation of the magnetic material (the soft magnetic layers) is increased by laminating nano-crystal soft magnetic ribbons and the laminated body 15*c* is strong, and thus can be handled easily.

Since the laminated body 15*c* of the embodiment is formed by laminating nano-crystal soft magnetic ribbons, a current path is divided at locations in the lamination direction. Furthermore, when each soft magnetic ribbon (each of the soft magnetic layers) has the micro gaps and is segmented, the current path is also divided at locations in a direction crossing the lamination direction. Therefore, in the coil component having the magnetic core of the embodiment, an eddy current path accompanying the change of the magnetic fluxes in an alternating magnetic field is divided in all directions, and eddy current loss can be greatly reduced.

Moreover, although the laminated body 15*c* of the embodiment is positioned inside the coil (inside the through hole) in the coil component 2, the laminated body 15*c* is not necessary to be positioned inside the coil. The laminated body 15*c* may be positioned along a route of a magnetic path. That is, the laminated body 15*c* may be positioned outside the coil. In addition, with respect to the direction of the laminated body 15*c*, the soft magnetic layers are preferably arranged substantially in parallel with the flow direction of the magnetic fluxes. This is true regardless of the position of the laminated body 15*c*.

Use of the coil component of the embodiment is not particularly limited. For example, the coil component is used for inductors for power supply circuits, switching power supplies, DC/DC converters, and the like.

Examples

Experiment 1

Manufacture of Soft Magnetic Ribbon

In Experiment 1, an amorphous soft magnetic ribbon and a soft magnetic ribbon consisting of Fe-based nano-crystals are manufactured. First, the method for manufacturing the amorphous soft magnetic ribbon is described. Raw metals are weighed in a manner that the composition of the amorphous soft magnetic ribbon is the Fe—Si—B composition ($Fe_{75}Si_{10}B_{15}$). Each weighed raw metal is melted by high frequency heating to manufacture a mother alloy.

Then, the manufactured mother alloy is heated and melted to obtain a molten metal of 1250° C. Thereafter, the metal is sprayed onto a roll by a single roll method using a roll of 60° C. at a rotational speed of 20 m/sec in the air atmosphere, and the soft magnetic ribbon is made. The thickness of the soft magnetic ribbon is controlled to be the thickness shown in Tables 1, 2 below. The width of the soft magnetic ribbon is about 50 mm.

Next, it is confirmed that the obtained soft magnetic ribbon has an amorphous structure. It is confirmed by a normal X-ray diffraction measurement (XRD) and observation using a transmission electron microscope (TEM) that the obtained soft magnetic ribbon has an amorphous structure.

Next, a method for manufacturing the soft magnetic ribbon consisting of Fe-based nano-crystals is described. Raw metals are weighed in a manner that the composition of the soft magnetic ribbon consisting of Fe-based nano-crystals is a Fe-M-B composition ($Fe_{81}Nb_7B_9P_3$). Each weighed raw metal is melted by high frequency heating to manufacture a mother alloy.

Then, the manufactured mother alloy is heated and melted to obtain a molten metal of 1250° C. Thereafter, the metal is sprayed onto a roll by a single roll method using a roll of 60° C. at a rotational speed of 20 m/sec in the air atmosphere, and the soft magnetic ribbon is made. The thickness of the soft magnetic ribbon is controlled to be the thickness shown in Tables 1, 2 below. The width of the soft magnetic ribbon is about 50 mm. Moreover, it is confirmed that the thickness of the soft magnetic ribbon substantially coincides with the thickness of each of the soft magnetic layers described later.

Next, a heat treatment is performed. As for the heat treatment conditions, the heat treatment temperature is set to 600° C., the holding time set to 60 minutes, the heating speed set to 1° C./min, and the cooling speed set to 1° C./min.

Next, it is confirmed that the obtained soft magnetic ribbon has a structure consisting of Fe-based nano-crystals. It is confirmed by a normal X-ray diffraction measurement (XRD) and observation using a transmission electron microscope (TEM) that the obtained soft magnetic ribbon has the structure consisting of Fe-based nano-crystals. Moreover, the structure consisting of Fe-based nano-crystals has a bcc crystal structure. Furthermore, it is confirmed that the average grain size of the Fe-based nano-crystals is 5.0 nm or more and 30 nm or less.

Evaluation of Soft Magnetic Ribbon

Furthermore, the saturation magnetic flux density Bs and the coercive force Hca of each soft magnetic ribbon are measured. The saturation magnetic flux density is measured at a magnetic field of 1000 kA/m using a vibrating sample magnetometer (VSM). The coercive force is measured at a magnetic field of 5 kA/m using a DC BH tracer. The amorphous soft magnetic ribbon has a saturation magnetic flux density Bs of 1.5 T and a coercive force Hc of 2.5 A/m. The soft magnetic ribbon consisting of Fe-based nano-crystals has a saturation magnetic flux density Bs of 1.48 T and a coercive force Hc of 2.8 A/m.

Manufacture of Laminated Body

Sample 2-Sample 5

First, a resin solution is applied to an amorphous soft magnetic ribbon. Thereafter, the solvent is dried, and adhesion layers are formed on both surfaces of the soft magnetic ribbon, thereby manufacturing a magnetic sheet A. Moreover, the thickness of each of the adhesion layers is made in a manner that the thickness of each of the adhesion layers in the finally obtained laminated body is 5 μm per layer.

Next, the manufactured magnetic sheet A is subjected to micro gaps forming process in a manner that the number of small pieces per unit area of the soft magnetic ribbon becomes the number shown in Table 2, and the magnetic sheet A is segmented. Moreover, the micro gaps forming process is not performed on Sample 2 in which the number of small pieces is one.

Next, after bonding and laminating the magnetic sheets A, in order to make the shape of the surface perpendicular to the laminating direction into a rectangular shape of 0.75 mm×0.90 mm=0.675 $mm^2$, the magnetic sheets A are cut with a precision processing machine, and a laminated body of 0.75 mm×W (mm)×0.90 mm is obtained. Moreover, W is the length in the lamination direction. Values of W are shown in Table 2 below. In addition, the lamination number and the volume occupation of the soft magnetic layers of the obtained laminated body are values shown in Table 2 below.

Samples 6-13

First, a resin solution is applied to a soft magnetic ribbon consisting of Fe-based nano-crystals. Thereafter, the solvent is dried, and adhesion layers are formed on both surfaces of the soft magnetic ribbon, thereby producing a magnetic sheet B. Moreover, the thickness of each of the adhesion layers is determined in a manner that the volume occupation of the soft magnetic layers in the finally obtained laminated body is the value shown in Table 1.

Next, the manufactured magnetic sheet B is subjected to micro gaps forming process in a manner that the number of small pieces per unit area of the soft magnetic ribbon becomes the number shown in Table 1, and the magnetic sheet B is segmented. Moreover, the micro gaps forming process is not performed on Sample 6 in which the number of small pieces is one.

Next, after bonding and laminating magnetic sheets B, in order to make the shape of a surface perpendicular to the lamination direction to be a rectangular shape of 0.75 mm×0.90 mm=0.675 $mm^2$, the magnetic sheets B are cut with a precision processing machine, and a laminated body of 0.75 mm×W (mm)×0.90 mm is obtained. Values of W are shown in Table 1 below. In addition, the lamination number and the volume occupation of the soft magnetic layers in the obtained laminated body are the values shown in Table 1 below.

Samples 14-17

First, a magnetic sheet A is prepared in the same manner as Samples 2-5.

Next, a magnetic sheet C is prepared. First, metal magnetic powder having a Fe—Si—B—Cr composition ($Fe_{73.5}Si_{11}B_{10}Cr_{2.5}C_3$) is prepared. Moreover, the metal magnetic powder has a spherical shape and is amorphous.

Next, the metal magnetic powder is mixed with a thermosetting resin, a binder and a solvent to produce a paste. Next, the paste is formed into a sheet by a doctor blade method. Specifically, the paste is applied on a carrier film and then dried. Moreover, the thickness of each of the magnetic sheet is determined in a manner that the thickness of each of the metal magnetic powder layer in the finally obtained laminated body is 15 μm. Next, adhesion layers are formed on both surfaces of the magnetic sheet, and the magnetic sheet C is obtained. The thickness of each of the adhesion layers is determined in a manner that the thickness of each of the adhesion layers in the finally obtained laminated body is 5 μm per layer.

Next, the manufactured magnetic sheet C is subjected to micro gaps forming process in a manner that the number of small pieces per unit area of the soft magnetic ribbon becomes the number shown in Table 2, and the magnetic sheet C is segmented. Moreover, the micro gaps forming process is not performed on Sample 14 in which the number of small pieces is one.

Then, the magnetic sheet A used in Samples 2-5 is segmented in the same manner as the magnetic sheet C. Then, the above magnetic sheets A and the above magnetic sheets C are alternately laminated and are cut by a precision processing machine to make the shape of the surface perpendicular to the laminating direction into a rectangular shape of 0.75 mm×0.90 mm=0.675 $mm^2$ to obtain a laminated body of 0.75 mm×W (mm)×0.90 mm. Values of W are shown in Table 2 below. In addition, the lamination number and the volume occupation of the soft magnetic layers of the obtained magnetic core are as shown in Table 2 below. The lamination number in Table 2 is the same as the number of the magnetic sheets A. Moreover, in Samples 14-17, the volume occupation is unknown because the volume occupation cannot be evaluated based on the same criteria as the volume occupation of the soft magnetic layers in the laminated body of Samples 2-13.

Furthermore, the coil component 2 shown in FIG. 1 is manufactured using the obtained laminated body. Moreover, in Sample 1, the laminated body is not used. The results of Sample 1 are shown in Tables 1, 2.

First, a substrate having a thickness of 60 μm is used as the insulation substrate 11. The substrate is a substrate in which a glass cloth is impregnated with a cyanate resin. The cyanate resin is BT (Bismaleimide-Triazine) resin (registered trademark). In addition, this substrate is also referred to as a BT printed substrate.

Next, the spiral internal conductor passages 12, 13 are formed by electrolytic plating on the upper and lower surfaces of the insulation substrate 11. Moreover, the material of the internal conductor passages 12, 13 is Cu.

Next, the protective insulation layers 14 are formed on both surfaces of the insulation substrate 11 on which the internal conductor passages 12, 13 are formed, and through holes are arranged in the insulation substrate 11 and the protective insulation layers 14.

Next, the protective insulation layer 14 in contact with the internal conductor passage 13 is fixed on a UV tape. Next, large-diameter powder, medium-diameter powder and small-diameter powder contained in the metal magnetic powder are prepared for the manufacture of the metal magnetic powder. Fe-based amorphous powder (manufactured by Epson Atmix Co., Ltd.) having a D50 of 26 μm is prepared as the large-diameter powder. Fe-based amorphous powder (manufactured by Epson Atmix Co., Ltd.) having a D50 of 4.0 μm is prepared as the medium diameter powder. Besides, Ni—Fe alloy powder (manufactured by Shoei Chemical Industry Co., Ltd.) having a Ni content of 78% by weight, D50 of 0.9 μm, and D90 of 1.2 μm is prepared as the small-diameter powder. A paste of mixed magnetic powder having a mixture ratio of 75 wt % of the large-diameter powder, 12.5 wt % of the medium-diameter powder, and 12.5 wt % of the small-diameter powder is prepared as a magnetic-substance-containing resin paste.

Thereafter, the upper core 15*a* and the lower core 15*b* are integrally formed with the laminated body 15*c* using the above-described magnetic-substance-containing resin paste, and the external electrode 4 is further formed, thereby manufacturing the coil component 2. Moreover, with respect to the direction of the laminated body 15*c*, the soft magnetic layers are arranged substantially in parallel with the flow direction of the magnetic fluxes. Besides, the inductance L is measured using an impedance analyzer. The measurement frequency is set to 100 kHz. The results are shown in Table 1. The inductance L is good when the inductance L is improved by 10% or more from Sample 1 in which the laminated body is not used. Moreover, in the example, since the inductance L of Sample 1 is 0.41 pH, a case where the inductance L is 0.45 μH or more is good.

Next, a current Is based on the inductance change and a current Itemp based on the temperature rise are measured using an LCR meter and a thermocouple. The measurement frequency is set to 100 kHz. Is is a current value when the inductance L is 0.3 μH. In addition, Itemp is a current value when the temperature increases by 40° C. due to self-heating compared with a case where no direct current is applied. It can be evaluated that the core loss is suppressed as each current increase. The results are shown in Tables 1, 2. Moreover, in the measurement of Itemp, the temperature is measured by applying the thermocouple to the coil surface. In the example, a case where Is is 5.5 A or more and Itemp is 5.0 A or more is good. Moreover, in Sample 1 in which the laminated body is not used, Is=5.1 A and Itemp=4.9 A, both being poor.

TABLE 1

| Sample No. | Example/ Comparative Example | Magnetic sheet type | Fe-based nano-crystals of soft magnetic layer | Lamination number | The number of small pieces/ piece | The number of small pieces/ (pieces/$cm^2$) | Soft magnetic layer thickness/ μm | Volume occupation/% | W/μm | L/μH | Is/A | Itemp/A |
|---|---|---|---|---|---|---|---|---|---|---|---|---|
| Sample 1 | Comparative Example | | | | No laminated body | | | | | 0.41 | 5.1 | 4.9 |
| Sample 6 | Comparative Example | Magnetic sheet B | Yes | 17 | 1 | 148 | 20 | 80 | 425 | 0.54 | 4.9 | 4.5 |
| Sample 7 | Example | Magnetic sheet B | Yes | 17 | 2 | 296 | 20 | 80 | 425 | 0.52 | 5.5 | 5.0 |
| Sample 8 | Example | Magnetic sheet B | Yes | 17 | 10 | 1480 | 20 | 80 | 425 | 0.50 | 5.7 | 5.3 |
| Sample 9 | Example | Magnetic sheet B | Yes | 17 | 50 | 7400 | 20 | 80 | 425 | 0.49 | 5.8 | 5.6 |
| Sample 10 | Example | Magnetic sheet B | Yes | 11 | 2 | 296 | 20 | 50 | 440 | 0.45 | 5.5 | 5.0 |

TABLE 1-continued

| Sample No. | Example/ Comparative Example | Magnetic sheet type | Fe-based nano-crystals of soft magnetic layer | Lamination number | The number of small pieces/ piece | The number of small pieces/ (pieces/cm$^2$) | Soft magnetic layer thickness/ μm | Volume occupation/% | W/μm | L/μH | Is/A | Itemp/A |
|---|---|---|---|---|---|---|---|---|---|---|---|---|
| Sample 11 | Example | Magnetic sheet B | Yes | 15 | 2 | 296 | 20 | 67 | 450 | 0.48 | 5.5 | 5.2 |
| Sample 12 | Example | Magnetic sheet B | Yes | 20 | 2 | 296 | 20 | 95 | 420 | 0.53 | 5.6 | 5.2 |
| Sample 13 | Example | Magnetic sheet B | Yes | 21 | 2 | 296 | 20 | 99.5 | 422 | 0.54 | 5.7 | 5.1 |
| Sample 13a | Example | Magnetic sheet B | Yes | 29 | 2 | 296 | 10 | 67 | 435 | 0.53 | 5.5 | 5.3 |
| Sample 13b | Example | Magnetic sheet B | Yes | 17 | 2 | 296 | 20 | 80 | 425 | 0.54 | 5.6 | 5.2 |
| Sample 13c | Example | Magnetic sheet B | Yes | 12 | 2 | 296 | 30 | 86 | 420 | 0.55 | 5.7 | 5.1 |

TABLE 2

| Sample No. | Example/ Comparative Example | Magnetic sheet type | Fe-based nano-crystals of soft magnetic layer | Lamination number | The number of small pieces/ piece | The number of small pieces/ (pieces/cm$^2$) | Soft magnetic layer thickness/ μm | Volume occupation/% | W/μm | L/μH | Is/A | Itemp/A |
|---|---|---|---|---|---|---|---|---|---|---|---|---|
| Sample 1 | Comparative Example | | | | No laminated body | | | | | 0.41 | 5.1 | 4.9 |
| Sample 2 | Comparative Example | Magnetic sheet A | None | 17 | 1 | 148 | 20 | 80 | 425 | 0.45 | 4.8 | 3.2 |
| Sample 3 | Comparative Example | Magnetic sheet A | None | 17 | 2 | 296 | 20 | 80 | 425 | 0.43 | 4.7 | 3.3 |
| Sample 4 | Comparative Example | Magnetic sheet A | None | 17 | 10 | 1480 | 20 | 80 | 425 | 0.42 | 4.7 | 3.4 |
| Sample 5 | Comparative Example | Magnetic sheet A | None | 17 | 20 | 2960 | 20 | 80 | 425 | 0.41 | 4.6 | 3.4 |
| Sample 14 | Comparative Example | Magnetic sheet A + Magnetic sheet C | None | 10 | 1 | 148 | 20 | — | 450 | 0.44 | 4.8 | 3.6 |
| Sample 15 | Comparative Example | Magnetic sheet A + Magnetic sheet C | None | 10 | 2 | 296 | 20 | — | 450 | 0.43 | 4.9 | 3.8 |
| Sample 16 | Comparative Example | Magnetic sheet A + Magnetic sheet C | None | 10 | 10 | 1480 | 20 | — | 450 | 0.42 | 4.9 | 3.9 |
| Sample 17 | Comparative Example | Magnetic sheet A + Magnetic sheet C | None | 10 | 20 | 2960 | 20 | — | 450 | 0.42 | 4.9 | 4.0 |

From Tables 1 and 2, Samples 7-13 in which the soft magnetic layers have a structure consisting of Fe-based nano-crystals and the number of small pieces per unit area is 150 pieces/$cm^2$ or more and 10,000 pieces/$cm^2$ or less have good inductance, Is and Itemp. That is, the inductance can be improved and the core loss can be reduced. On the other hand, Samples 2-5 and 14-17 in which the soft magnetic layers have an amorphous structure have poor inductance, Is and/or Itemp.

In Samples 2-5 and 14-17, since the soft magnetic ribbon is amorphous, it is considered that processing stress at the time of processing and at the time of micro gaps formation is very large. Besides, it is considered that the core loss of the laminated body rises and the inductance, Is, and/or Itemp at the time of manufacturing an inductor deteriorated. On the other hand, in Samples 7-13, since the soft magnetic ribbon is made of nano-crystals, it is considered that the processing stress at the time of processing and at the time of micro gaps formation is small. Besides, it is considered that the increase in the core loss of the laminated body can be suppressed, and the inductance, Is, and Itemp at the time of producing the inductor are improved.

In addition, Sample 6 in which the soft magnetic layers have the structure consisting of Fe-based nano-crystals but is not divided into small pieces has poor Is and Itemp.

the face plate and applying pressure from the face plate side toward the punching mold side.

Next, the punched segmented magnetic sheets are bonded and laminated to have a height of about 5 mm to obtain a toroidal laminated body. Furthermore, 30 toroidal laminated bodies are manufactured for each sample by the same procedure.

Next, magnetic characteristics of the toroidal laminated body are evaluated. First, the coercive force Hcb of the laminated body is measured at a magnetic field of 5 kA/m using a DC BH tracer in the same manner as the coercive force Hca of the ribbon. Moreover, Hcb is obtained by measuring the coercive force for each of the 30 laminated bodies and obtaining an average value.

Subsequently, a coercive force change amount ΔHc (=Hcb−Hca) is calculated from the obtained Hca and Hcb. A case where the coercive force change amount ΔHc is less than 10 A/m is good.

Finally, a coil is wound around each of the obtained laminated bodies along a circumferential direction of the toroidal shape to manufacture 30 coil components. Then, the inductance L of each coil component is measured at a frequency of 100 kHz using an LCR meter and an average value is obtained. The results are shown in Table 3.

TABLE 3

| Sample No. | Saturation magnetic flux density of ribbon Bs/T | Coercive force of ribbon Hca/(A/m) | The number of small pieces/ (pieces/$cm^2$ ) | Coercive force of laminated body Hcb/(A/m) | ΔHc/ (A/m) | L/μH |
|---|---|---|---|---|---|---|
| Sample 25 | 1.53 | 2.9 | 150 | 4.8 | 1.9 | 610 |
| Sample 26 | 1.53 | 2.9 | 400 | 4.8 | 1.9 | 532 |
| Sample 27 | 1.53 | 2.9 | 3460 | 4.9 | 2.0 | 320 |
| Sample 28 | 1.53 | 2.9 | 10000 | 4.9 | 2.0 | 103 |
| Sample 29 | 1.53 | 2.9 | 1000000 | 4.9 | 2.0 | 18 |

Experiment 2

In Experiment 2, a toroidal laminated body divided into small pieces is manufactured, and changes in the coercive force and the inductance L of the core when the number of small pieces is changed are evaluated.

First, similarly to Experiment 1, a magnetic sheet (the magnetic sheet B of Experiment 1) is prepared using the soft magnetic ribbon having a Fe-M-B composition ($Fe_{81}Nb_7B_9P_3$) and consisting of Fe-based nano-crystals. Moreover, the thickness of each of the adhesion layers is determined in a manner that the volume occupation of the soft magnetic layers in the finally obtained toroidal laminated body is 85%.

Moreover, a saturation magnetic flux density Bs and a coercive force Hca of the above soft magnetic ribbon are measured at a magnetic field of 5 kA/m using a DC BH tracer. The results are shown in Table 3.

Next, the manufactured magnetic sheet is subjected to micro gaps forming process in a manner that the number of the small pieces per unit area of the soft magnetic ribbon becomes the number shown in Table 3, and a segmented magnetic sheet is manufactured.

Next, punching is performed in order to make the manufactured segmented magnetic sheet into a ring shape (an outer diameter of 18 mm, an inner diameter of 10 mm). Specifically, this punching is performed by clamping the segmented magnetic sheet between the punching mold and From Table 3, it is known that by forming micro gaps in the soft magnetic ribbon (each of the soft magnetic layers) and controlling the number of the small pieces, the coercive force change amount ΔHc is satisfactorily controlled, and the inductance L of the coil component consisting of the laminated body is controlled. Specifically, the inductance L in the coil component improves as the number of the small pieces decreases. In addition, when the inductance L of the coil component is small, it is easy to improve the direct current superposition characteristics. In other words, it is easy to increase Is.

That is, by controlling the number of the small pieces, it is possible to appropriately change the inductance L and the direct current superposition characteristics according to the purpose of use of the inductor.

Experiment 3

In Experiment 3, the same test as in Experiment 2 is performed, except that the composition of the soft magnetic ribbon is changed as shown in the table below. Moreover, only Sample 30 in Table 9 uses a soft magnetic ribbon manufactured in the same manner as the amorphous soft magnetic ribbon in Experiment 1 except for the composition. Moreover, the soft magnetic ribbon of Sample 30 is an amorphous soft magnetic ribbon, and the amorphous soft magnetic ribbon cannot be segmented.

TABLE 4

| Sample No. | $Fe_{(1-(a+b+c+d+e+f))}M_aB_bP_cSi_dC_eS_f(\alpha = \beta = 0)$ Fe | M(Nb) a | B b | P c | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 31 | 0.840 | 0.020 | 0.090 | 0.050 | 0.000 | 0.000 | 0.000 | 1.58 | 2.8 | 3800 | 4.8 | 2.0 |
| Sample 32 | 0.820 | 0.040 | 0.090 | 0.050 | 0.000 | 0.000 | 0.000 | 1.56 | 2.4 | 3400 | 4.3 | 1.9 |
| Sample 33 | 0.810 | 0.050 | 0.090 | 0.050 | 0.000 | 0.000 | 0.000 | 1.53 | 1.9 | 3400 | 3.4 | 1.5 |
| Sample 47 | 0.800 | 0.060 | 0.090 | 0.050 | 0.000 | 0.000 | 0.000 | 1.50 | 1.8 | 3500 | 3.2 | 1.4 |
| Sample 34 | 0.780 | 0.080 | 0.090 | 0.050 | 0.000 | 0.000 | 0.000 | 1.48 | 1.8 | 3580 | 3.3 | 1.5 |
| Sample 35 | 0.760 | 0.100 | 0.090 | 0.050 | 0.000 | 0.000 | 0.000 | 1.44 | 2.3 | 3567 | 4.3 | 2.0 |
| Sample 36 | 0.740 | 0.120 | 0.090 | 0.050 | 0.000 | 0.000 | 0.000 | 1.42 | 2.7 | 3700 | 5.0 | 2.3 |
| Sample 37 | 0.720 | 0.140 | 0.090 | 0.050 | 0.000 | 0.000 | 0.000 | 1.38 | 2.7 | 3600 | 5.1 | 2.4 |

TABLE 5

| Sample No. | $Fe_{(1-(a+b+c+d+e+f))}M_aB_bP_cSi_dC_eS_f(\alpha = \beta = 0)$ Fe | M(Nb) a | B b | P c | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 38 | 0.865 | 0.060 | 0.020 | 0.050 | 0.000 | 0.000 | 0.000 | 1.62 | 2.6 | 3500 | 4.4 | 1.8 |
| Sample 39 | 0.830 | 0.060 | 0.060 | 0.050 | 0.000 | 0.000 | 0.000 | 1.57 | 2.1 | 3500 | 3.7 | 1.6 |
| Sample 40 | 0.810 | 0.060 | 0.080 | 0.050 | 0.000 | 0.000 | 0.000 | 1.56 | 1.8 | 3400 | 3.2 | 1.4 |
| Sample 47 | 0.800 | 0.060 | 0.090 | 0.050 | 0.000 | 0.000 | 0.000 | 1.50 | 1.8 | 3500 | 3.2 | 1.4 |
| Sample 41 | 0.770 | 0.060 | 0.120 | 0.050 | 0.000 | 0.000 | 0.000 | 1.45 | 2.0 | 3300 | 3.7 | 1.7 |
| Sample 42 | 0.740 | 0.060 | 0.150 | 0.050 | 0.000 | 0.000 | 0.000 | 1.40 | 2.5 | 3200 | 4.7 | 2.2 |
| Sample 43 | 0.690 | 0.060 | 0.200 | 0.050 | 0.000 | 0.000 | 0.000 | 1.35 | 2.7 | 3300 | 5.1 | 2.4 |

TABLE 6

| Sample No. | $Fe_{(1-(a+b+c+d+e+f))}M_aB_bP_cSi_dC_eS_f(\alpha = \beta = 0)$ Fe | M(Nb) a | B b | P c | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 44 | 0.850 | 0.060 | 0.090 | 0.000 | 0.000 | 0.000 | 0.000 | 1.71 | 4.8 | 3400 | 8.1 | 3.3 |
| Sample 45 | 0.840 | 0.060 | 0.090 | 0.010 | 0.000 | 0.000 | 0.000 | 1.73 | 4.6 | 3400 | 7.9 | 3.3 |
| Sample 46 | 0.820 | 0.060 | 0.090 | 0.030 | 0.000 | 0.000 | 0.000 | 1.66 | 4.2 | 3500 | 7.4 | 3.2 |
| Sample 47 | 0.800 | 0.060 | 0.090 | 0.050 | 0.000 | 0.000 | 0.000 | 1.50 | 1.8 | 3500 | 3.2 | 1.4 |
| Sample 48 | 0.770 | 0.060 | 0.090 | 0.080 | 0.000 | 0.000 | 0.000 | 1.47 | 2.2 | 3600 | 4.0 | 1.8 |
| Sample 49 | 0.750 | 0.060 | 0.090 | 0.100 | 0.000 | 0.000 | 0.000 | 1.44 | 2.5 | 3700 | 4.6 | 2.1 |
| Sample 50 | 0.700 | 0.060 | 0.090 | 0.150 | 0.000 | 0.000 | 0.000 | 1.37 | 2.7 | 3800 | 5.1 | 2.4 |

TABLE 7

| Sample No. | $Fe_{(1-(a+b+c+d+e+f))}M_aB_bP_cSi_dC_eS_f(\alpha = \beta = 0)$ Fe | M (Nb) a | B b | P c | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 47 | 0.800 | 0.060 | 0.090 | 0.050 | 0.000 | 0.000 | 0.000 | 1.50 | 1.8 | 3500 | 3.2 | 1.4 |
| Sample 51 | 0.799 | 0.060 | 0.090 | 0.050 | 0.000 | 0.001 | 0.000 | 1.51 | 1.4 | 3900 | 2.5 | 1.1 |
| Sample 52 | 0.795 | 0.060 | 0.090 | 0.050 | 0.000 | 0.005 | 0.000 | 1.51 | 1.2 | 3800 | 2.2 | 1.0 |
| Sample 53 | 0.790 | 0.060 | 0.090 | 0.050 | 0.000 | 0.010 | 0.000 | 1.50 | 1.5 | 3800 | 2.7 | 1.2 |
| Sample 54 | 0.770 | 0.060 | 0.090 | 0.050 | 0.000 | 0.030 | 0.000 | 1.48 | 1.7 | 3900 | 3.1 | 1.4 |
| Sample 55 | 0.799 | 0.060 | 0.090 | 0.050 | 0.000 | 0.000 | 0.001 | 1.53 | 2.1 | 3700 | 3.8 | 1.7 |
| Sample 56 | 0.795 | 0.060 | 0.090 | 0.050 | 0.000 | 0.000 | 0.005 | 1.51 | 2.3 | 3700 | 4.2 | 1.9 |
| Sample 57 | 0.790 | 0.060 | 0.090 | 0.050 | 0.000 | 0.000 | 0.010 | 1.52 | 2.2 | 3800 | 4.0 | 1.8 |
| Sample 58 | 0.770 | 0.060 | 0.090 | 0.050 | 0.000 | 0.000 | 0.030 | 1.43 | 2.4 | 3900 | 4.4 | 2.0 |

TABLE 8

| Sample No. | $Fe_{(1-(a+b+c+d+e+f))}M_aB_bP_cSi_dC_eS_f$ ($\alpha = \beta = 0$) Fe | M(Nb) a | B b | P c | Si d | C e | s f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 47 | 0.800 | 0.060 | 0.090 | 0.050 | 0.000 | 0.000 | 0.000 | 1.50 | 1.8 | 3500 | 3.2 | 1.4 |
| Sample 59 | 0.795 | 0.060 | 0.090 | 0.050 | 0.005 | 0.000 | 0.000 | 1.53 | 1.7 | 3800 | 3.1 | 1.4 |
| Sample 60 | 0.790 | 0.060 | 0.090 | 0.050 | 0.010 | 0.000 | 0.000 | 1.52 | 1.6 | 3800 | 2.9 | 1.3 |
| Sample 61 | 0.780 | 0.060 | 0.090 | 0.050 | 0.020 | 0.000 | 0.000 | 1.50 | 1.6 | 3600 | 2.9 | 1.3 |
| Sample 62 | 0.770 | 0.060 | 0.090 | 0.050 | 0.030 | 0.000 | 0.000 | 1.46 | 2.1 | 3400 | 3.9 | 1.8 |
| Sample 63 | 0.740 | 0.060 | 0.090 | 0.050 | 0.060 | 0.000 | 0.000 | 1.42 | 2.5 | 3400 | 4.7 | 2.2 |
| Sample 64 | 0.810 | 0.030 | 0.090 | 0.000 | 0.070 | 0.000 | 0.000 | 1.45 | 4.8 | 3700 | 8.6 | 3.8 |
| Sample 65 | 0.790 | 0.030 | 0.090 | 0.000 | 0.090 | 0.000 | 0.000 | 1.35 | 4.5 | 3800 | 8.2 | 3.7 |
| Sample 66 | 0.745 | 0.030 | 0.090 | 0.000 | 0.135 | 0.000 | 0.000 | 1.31 | 4.8 | 3800 | 8.9 | 4.1 |
| Sample 67 | 0.725 | 0.030 | 0.090 | 0.000 | 0.155 | 0.000 | 0.000 | 1.20 | 4.3 | 3600 | 8.1 | 3.8 |
| Sample 68 | 0.705 | 0.030 | 0.090 | 0.000 | 0.175 | 0.000 | 0.000 | 1.18 | 3.2 | 3500 | 6.1 | 2.9 |

TABLE 9

| Sample No. | $Fe_{(1-(a+b+c+d+e+f))}M_aB_bP_cSi_dC_eS_f$ ($\alpha = \beta = 0$) Fe | M (Nb) a | B b | P c | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 30 | 0.750 | 0.000 | 0.100 | 0.000 | 0.150 | 0.000 | 0.000 | 1.55 | 2.5 | Cannot be fragmented | 13.0 | 10.5 |
| Sample 69 | 0.850 | 0.000 | 0.090 | 0.050 | 0.010 | 0.000 | 0.000 | 1.74 | 10.8 | 3600 | 18.2 | 7.4 |
| Sample 70 | 0.830 | 0.000 | 0.090 | 0.050 | 0.030 | 0.000 | 0.000 | 1.73 | 9.5 | 3500 | 16.6 | 7.1 |
| Sample 71 | 0.810 | 0.000 | 0.090 | 0.050 | 0.050 | 0.000 | 0.000 | 1.70 | 9.3 | 3400 | 16.6 | 7.3 |
| Sample 72 | 0.790 | 0.000 | 0.090 | 0.050 | 0.070 | 0.000 | 0.000 | 1.66 | 9.2 | 3400 | 16.7 | 7.5 |
| Sample 73 | 0.770 | 0.000 | 0.090 | 0.050 | 0.090 | 0.000 | 0.000 | 1.64 | 9.4 | 3700 | 17.3 | 7.9 |

TABLE 10

| Sample No. | $F_{(1-(a+b+c+d+e+f))}M_aB_bP_cSi_dC_eS_f$ ($\alpha = \beta = 0$) Fe | M (Nb) a | B b | P C | Si d | C e | S f | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|---|---|---|
| Sample 74 | 0.730 | 0.080 | 0.120 | 0.070 | 0.000 | 0.000 | 0.000 | 1.40 | 2.9 | 3500 | 5.4 | 2.5 |
| Sample 47 | 0.800 | 0.060 | 0.090 | 0.050 | 0.000 | 0.000 | 0.000 | 1.50 | 1.8 | 3500 | 3.2 | 1.4 |
| Sample 75 | 0.880 | 0.040 | 0.030 | 0.050 | 0.000 | 0.000 | 0.000 | 1.67 | 2.7 | 3400 | 4.6 | 1.9 |
| Sample 76 | 0.900 | 0.030 | 0.030 | 0.040 | 0.000 | 0.000 | 0.000 | 1.70 | 2.6 | 3200 | 4.4 | 1.8 |

TABLE 11

| Sample No. | $Fe_{(1-(a+b+c+d+e+f))}M_aB_bP_cSi_dC_eS_f$ ($\alpha = \beta = 0$, b-f are the same as sample number 47) M Type | a | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|
| Sample 47 | Nb | 0.060 | 1.50 | 1.8 | 3500 | 3.2 | 1.4 |
| Sample 73 | Hf | 0.060 | 1.51 | 1.8 | 3200 | 3.8 | 2.0 |
| Sample 74 | Zr | 0.060 | 1.52 | 1.7 | 3400 | 4.0 | 2.3 |
| Sample 75 | Ta | 0.060 | 1.53 | 1.7 | 3580 | 4.1 | 2.4 |
| Sample 76 | Mo | 0.060 | 1.50 | 2.0 | 3400 | 3.6 | 1.6 |
| Sample 77 | W | 0.060 | 1.50 | 2.0 | 3700 | 3.4 | 1.4 |
| Sample 78 | V | 0.060 | 1.51 | 1.9 | 3600 | 3.6 | 1.7 |
| Sample 79 | Ti | 0.060 | 1.51 | 2.0 | 3400 | 3.6 | 1.6 |
| Sample 80 | $Nb_{0.5}Hf_{0.5}$ | 0.060 | 1.52 | 1.8 | 3200 | 3.2 | 1.4 |
| Sample 81 | Zr0.5Ta0.5 | 0.060 | 1.53 | 1.9 | 3300 | 3.5 | 1.6 |
| Sample 82 | $Nb_{0.4}Hf_{0.3}Zr_{0.3}$ | 0.060 | 1.51 | 2.0 | 3300 | 3.5 | 1.5 |

TABLE 12

| Sample No. | $Fe_{(1-(\alpha+\beta))}X1_{\alpha}X2_{\beta}$ (a-f are the same as sample number 47) X1 Type | X1 $\alpha(1-(a+b+c+d+e+f))$ | X2 Type | X2 $\beta(1-(a+b+c+d+e+f))$ | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|
| Sample 47 | — | 0.000 | — | 0.000 | 1.50 | 1.8 | 3500 | 3.2 | 1.4 |
| Sample 89 | Co | 0.010 | — | 0.000 | 1.53 | 2.1 | 3200 | 3.8 | 1.7 |
| Sample 90 | Co | 0.100 | — | 0.000 | 1.55 | 2.5 | 3400 | 4.7 | 2.2 |
| Sample 91 | Co | 0.400 | — | 0.000 | 1.60 | 2.9 | 3580 | 5.6 | 2.7 |
| Sample 92 | Ni | 0.010 | — | 0.000 | 1.51 | 1.8 | 3400 | 3.2 | 1.4 |
| Sample 93 | Ni | 0.100 | — | 0.000 | 1.47 | 1.7 | 3700 | 3.0 | 1.3 |
| Sample 94 | Ni | 0.400 | — | 0.000 | 1.42 | 1.6 | 3600 | 2.8 | 1.2 |

TABLE 13

| Sample No. | $Fe_{(1-(\alpha+\beta))}X1_{\alpha}X2_{\beta}$ (a-f are the same as sample number 47) X1 Type | X1 $\alpha(1-(a+b+c+d+e+f))$ | X2 Type | X2 $\beta(1-(a+b+c+d+e+f))$ | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|
| Sample 47 | — | 0.000 | — | 0.000 | 1.50 | 1.8 | 3500 | 3.2 | 1.4 |
| Sample 95 | — | 0.000 | Al | 0.001 | 1.52 | 1.8 | 3400 | 3.2 | 1.4 |
| Sample 96 | — | 0.000 | Al | 0.005 | 1.51 | 1.8 | 3300 | 3.2 | 1.4 |
| Sample 97 | — | 0.000 | Al | 0.010 | 1.51 | 1.7 | 3300 | 3.0 | 1.3 |
| Sample 98 | — | 0.000 | Al | 0.030 | 1.50 | 1.8 | 3400 | 3.2 | 1.4 |
| Sample 99 | — | 0.000 | Zn | 0.001 | 1.50 | 1.8 | 3500 | 3.2 | 1.4 |
| Sample 100 | — | 0.000 | Zn | 0.005 | 1.52 | 1.9 | 3400 | 3.4 | 1.5 |
| Sample 101 | — | 0.000 | Zn | 0.010 | 1.50 | 1.8 | 3300 | 3.2 | 1.4 |
| Sample 102 | — | 0.000 | Zn | 0.030 | 1.51 | 1.9 | 3400 | 3.4 | 1.5 |
| Sample 103 | — | 0.000 | Sn | 0.001 | 1.52 | 1.8 | 3400 | 3.2 | 1.4 |
| Sample 104 | — | 0.000 | Sn | 0.005 | 1.51 | 1.9 | 3600 | 3.4 | 1.5 |
| Sample 105 | — | 0.000 | Sn | 0.010 | 1.52 | 1.9 | 3400 | 3.4 | 1.5 |
| Sample 106 | — | 0.000 | Sn | 0.030 | 1.50 | 2.0 | 3400 | 3.6 | 1.6 |
| Sample 107 | — | 0.000 | Cu | 0.001 | 1.52 | 1.6 | 3300 | 2.8 | 1.2 |
| Sample 108 | — | 0.000 | Cu | 0.005 | 1.52 | 1.7 | 3400 | 3.0 | 1.3 |
| Sample 109 | — | 0.000 | Cu | 0.010 | 1.52 | 1.5 | 3200 | 2.6 | 1.1 |
| Sample 110 | — | 0.000 | Cu | 0.030 | 1.54 | 1.6 | 3300 | 2.8 | 1.2 |

TABLE 14

| Sample No. | $Fe_{(1-(\alpha+\beta))}X1_{\alpha}X2_{\beta}$ (a-f are the same as sample number 47) X1 Type | X1 $\alpha(1-(a+b+c+d+e+f))$ | X2 Type | X2 $\beta(1-(a+b+c+d+e+f))$ | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|
| Sample 47 | — | 0.000 | — | 0.000 | 1.50 | 1.8 | 3500 | 3.2 | 1.4 |
| Sample 111 | — | 0.000 | Cr | 0.001 | 1.52 | 1.8 | 3400 | 3.2 | 1.4 |
| Sample 112 | — | 0.000 | Cr | 0.005 | 1.51 | 1.7 | 3400 | 3.0 | 1.3 |
| Sample 113 | — | 0.000 | Cr | 0.010 | 1.50 | 1.8 | 3400 | 3.2 | 1.4 |
| Sample 114 | — | 0.000 | Cr | 0.030 | 1.51 | 1.9 | 3200 | 3.4 | 1.5 |
| Sample 115 | — | 0.000 | Bi | 0.001 | 1.51 | 1.8 | 3100 | 3.2 | 1.4 |
| Sample 116 | — | 0.000 | Bi | 0.005 | 1.50 | 1.7 | 3500 | 3.0 | 1.3 |
| Sample 117 | — | 0.000 | Bi | 0.010 | 1.49 | 1.8 | 3500 | 3.2 | 1.4 |
| Sample 118 | — | 0.000 | Bi | 0.030 | 1.48 | 2.0 | 3400 | 3.6 | 1.6 |
| Sample 119 | — | 0.000 | La | 0.001 | 1.52 | 1.8 | 3500 | 3.2 | 1.4 |
| Sample 120 | — | 0.000 | La | 0.005 | 1.51 | 1.9 | 3400 | 3.4 | 1.5 |
| Sample 121 | — | 0.000 | La | 0.010 | 1.49 | 2.1 | 3200 | 3.8 | 1.7 |
| Sample 122 | — | 0.000 | La | 0.030 | 1.48 | 2.1 | 3300 | 3.8 | 1.7 |
| Sample 123 | — | 0.000 | Y | 0.001 | 1.51 | 1.9 | 3300 | 3.4 | 1.5 |
| Sample 124 | — | 0.000 | Y | 0.005 | 1.49 | 1.8 | 3500 | 3.2 | 1.4 |
| Sample 125 | — | 0.000 | Y | 0.010 | 1.48 | 1.8 | 3300 | 3.2 | 1.4 |
| Sample 126 | — | 0.000 | Y | 0.030 | 1.49 | 2.0 | 3400 | 3.6 | 1.6 |

TABLE 14-continued

| Sample No. | $Fe_{(1-(\alpha+\beta))}X1_{\alpha}X2_{\beta}$ (a-f are the same as sample number 47) X1 Type | $\alpha(1-(a+b+c+d+e+f))$ | X2 Type | $\beta(1-(a+b+c+d+e+f))$ | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|
| Sample 127 | — | 0.000 | N | 0.001 | 1.49 | 2.0 | 3400 | 3.6 | 1.6 |
| Sample 128 | — | 0.000 | O | 0.001 | 1.50 | 1.9 | 3400 | 3.4 | 1.5 |

TABLE 15

| Sample No. | $Fe_{(1-(\alpha+\beta))}X1_{\alpha}X2_{\beta}$ (a-f are the same as sample number 47) X1 Type | $\alpha(1-(a+b+c+d+e+f))$ | X2 Type | $\beta(1-(a+b+c+d+e+f))$ | Saturation magnetic flux density of ribbon Bs/T | Coercive force of ribbon Hca/(A/m) | The number of small pieces/ (pieces/cm$^2$) | Coercive force of laminated body Hcb/(A/m) | ΔHc/ (A/m) |
|---|---|---|---|---|---|---|---|---|---|
| Sample 47 | — | 0.000 | — | 0.000 | 1.50 | 1.8 | 3500 | 3.2 | 1.4 |
| Sample 129 | Co | 0.100 | Al | 0.050 | 1.52 | 2.1 | 3400 | 3.8 | 1.7 |
| Sample 130 | Co | 0.100 | Zn | 0.050 | 1.54 | 2.2 | 3500 | 4.0 | 1.8 |
| Sample 131 | Co | 0.100 | Sn | 0.050 | 1.53 | 2.2 | 3600 | 4.0 | 1.8 |
| Sample 132 | Co | 0.100 | Cu | 0.050 | 1.53 | 2.0 | 3300 | 3.6 | 1.6 |
| Sample 133 | Co | 0.100 | Cr | 0.050 | 1.53 | 2.1 | 3500 | 3.8 | 1.7 |
| Sample 134 | Co | 0.100 | Bi | 0.050 | 1.51 | 2.2 | 3400 | 4.0 | 1.8 |
| Sample 135 | Co | 0.100 | La | 0.050 | 1.52 | 2.3 | 3300 | 4.3 | 2.0 |
| Sample 136 | Co | 0.100 | Y | 0.050 | 1.53 | 2.3 | 3400 | 4.3 | 2.0 |
| Sample 137 | Ni | 0.100 | Al | 0.050 | 1.48 | 1.7 | 3300 | 3.0 | 1.3 |
| Sample 138 | Ni | 0.100 | Zn | 0.050 | 1.47 | 1.7 | 3400 | 3.0 | 1.3 |
| Sample 139 | Ni | 0.100 | Sn | 0.050 | 1.48 | 1.6 | 3500 | 2.8 | 1.2 |
| Sample 140 | Ni | 0.100 | Cu | 0.050 | 1.49 | 1.6 | 3500 | 2.8 | 1.2 |
| Sample 141 | Ni | 0.100 | Cr | 0.050 | 1.47 | 1.7 | 3300 | 3.0 | 1.3 |
| Sample 142 | Ni | 0.100 | Bi | 0.050 | 1.48 | 1.8 | 3400 | 3.2 | 1.4 |
| Sample 143 | Ni | 0.100 | La | 0.050 | 1.46 | 1.8 | 3400 | 3.2 | 1.4 |
| Sample 144 | Ni | 0.100 | Y | 0.050 | 1.45 | 1.8 | 3500 | 3.2 | 1.4 |

In Experiment 3, the coercive force change amount ΔHc is satisfactorily controlled in all the samples other than Sample 30. On the other hand, in Sample 30, the coercive force change amount ΔHc is large. That is, it is found that when the soft magnetic ribbon has an amorphous structure and cannot be segmented, the coercive force of the laminated body becomes larger compared with the coercive force of the ribbon.

Moreover, it is confirmed that among Samples 25-144 in Experiments 2-3, all the soft magnetic ribbons other than Sample 30 have the crystal structure consisting of Fe-based nano-crystals, and the average grain size of the Fe-based nano-crystals is 5.0 nm or more and 30 nm or less.

REFERENCE SIGNS LIST

2 coil component
4 terminal electrode
11 insulation substrate
12, 13 internal conductor passage
12*b*, 13*b* lead contact
14 protective insulation layer
15 magnetic core
15*a* upper core
15*b* lower core
15*c* laminated body

What is claimed is:

1. A coil component, comprising a coil and a magnetic core, wherein the coil is formed inside the magnetic core, the magnetic core has a laminated body in which soft magnetic layers are punched and laminated, micro gaps are formed in the soft magnetic layers, the soft magnetic layers are divided into at least two or more small pieces by the micro gaps, the number of the small pieces into which the soft magnetic layers are divided is 2 to 50 per layer, the number of the small pieces per unit area is 296 pieces/cm$^2$ or more and 1000000 pieces/cm$^2$ or less, a structure consisting of Fe-based nano-crystals is observed in the soft magnetic layers, the laminated body has a ΔHc calculated as a difference in coercive force before and after the soft magnetic layers are divided into small pieces and punched of 7.5 A/m or less, the soft magnetic layers have a composition formula $(Fe_{(1-(\alpha+\beta))}X1_{\alpha}X2_{\beta})_{(1-(a+b+c+d+e+f))}M_aB_bP_cSi_dC_eS_f$, X1 is one or more elements selected from a group consisting of Co and Ni, X2 is one or more elements selected from a group consisting of Al, Mn, Ag, Zn, Sn, As, Sb, Cu, Cr, Bi, N, O and rare earth elements, M is one or more elements selected from a group consisting of Nb, Hf, Zr, Ta, Mo, W, Ti and V, $0 \le a \le 0.140$ $0.020 \le b \le 0.200$ $0 \le c \le 0.150$ $0 \le d \le 0.090$ $0 \le e \le 0.030$ $0 \le f \le 0.030$ $\alpha \geq 0$ $\beta \geq 0$ $0 \leq \alpha + \beta \leq 0.50$, and at least one or more of a, c and d is greater than zero.

2. The coil component according to claim 1, wherein the number of the small pieces per unit area is 296 pieces/$cm^2$ or more and 10000 pieces/$cm^2$ or less.

3. The coil component according to claim 1, wherein soft magnetic layers and adhesion layers are alternately laminated in the laminated body.

4. The coil component according to claim 1, wherein the soft magnetic layers are arranged substantially in parallel with a flow direction of magnetic fluxes.

5. The coil component according to claim 1, wherein the magnetic core comprises a magnetic-substance-containing resin, and the magnetic-substance-containing resin covers at least a part of the coil and at least a part of the laminated body.

6. The coil component according to claim 1, wherein the thickness of each of the soft magnetic layers is 10 μm or more and 30 μm or less.

7. The coil component according to claim 1, wherein a volume occupation of magnetic material containing the soft magnetic layers in the laminated body is 50% or more and 99.5% or less.

8. The coil component according to claim 1, wherein the average grain size of the Fe-based nano-crystals is 5 nm or more and 30 nm or less.

9. The coil component according to claim 1, wherein the laminated body contains from 2 to 10000 soft magnetic layers.

10. The coil component according to claim 1, wherein a=0.

11. The coil component according to claim 1, wherein the $\Delta Hc$ of the laminated body is 3.8 A/m or less when a is not 0.

* * * * *